US008246154B2

(12) United States Patent
Kamikura

(10) Patent No.: US 8,246,154 B2
(45) Date of Patent: Aug. 21, 2012

(54) LIQUID INJECTING HEAD, METHOD OF MANUFACTURING LIQUID INJECTING HEAD, AND LIQUID INJECTING APPARATUS

(75) Inventor: Hiroyuki Kamikura, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 517 days.

(21) Appl. No.: 12/370,801

(22) Filed: Feb. 13, 2009

(65) Prior Publication Data

US 2009/0207222 A1 Aug. 20, 2009

(30) Foreign Application Priority Data

Feb. 14, 2008 (JP) ..... 2008-033792

(51) Int. Cl.
*B41J 2/175* (2006.01)

(52) U.S. Cl. ..... 347/93

(58) Field of Classification Search ..... 347/93
See application file for complete search history.

(56) References Cited

U.S. PATENT DOCUMENTS

| | | | |
|---|---|---|---|
| 7,121,643 | B2 | 10/2006 | Yamada |
| 7,475,975 | B2 | 1/2009 | Shimizu |
| 7,775,652 | B2 | 8/2010 | Taira |
| 2007/0215744 | A1 | 9/2007 | Sogabe |
| 2009/0117401 | A1 | 5/2009 | Naritomi et al. |
| 2009/0122125 | A1* | 5/2009 | Owaki et al. ..... 347/93 |

FOREIGN PATENT DOCUMENTS

| | | | |
|---|---|---|---|
| JP | 59-135110 | U | 9/1984 |
| JP | 08-309988 | | 11/1996 |
| JP | 10-006511 | | 1/1998 |
| JP | 11-277758 | A | 10/1999 |
| JP | 2002-141683 | A | 5/2000 |
| JP | 2000-211130 | | 8/2000 |
| JP | 2002-067341 | A | 3/2002 |
| JP | 2004-025899 | | 1/2004 |
| JP | 2004-268454 | A | 9/2004 |
| JP | 2006-015506 | A | 1/2006 |
| JP | 2007-160821 | A | 6/2007 |
| JP | 2007-250139 | A | 9/2007 |
| JP | 2007-313730 | | 12/2007 |
| JP | 2007-331201 | A | 12/2007 |
| WO | 2007-138641 | A | 12/2007 |

* cited by examiner

*Primary Examiner* — Matthew Luu
*Assistant Examiner* — Lisa M Solomon
(74) *Attorney, Agent, or Firm* — Workman Nydegger

(57) ABSTRACT

A liquid injecting head includes a first supply member and a second supply member in which the liquid supplying path is formed and a filter that is pinched by the first supply member and the second supply member and is disposed in correspondence with the liquid supplying path. In areas that surround the liquid supplying path of the first supply member and the second supply member on the filter side and face each other, filter pinching parts that are brought into contact with the filter are included and concave parts that surround the filter pinching parts are included on the outer side of the filter pinching parts. In addition, the first supply member, the filter, and the second supply member are bonded together by a bonding resin that is formed by flowing into the concave parts of the first supply member and the second supply member.

6 Claims, 11 Drawing Sheets

LIQUID INJECTING HEAD, METHOD OF MANUFACTURING LIQUID INJECTING HEAD, AND LIQUID INJECTING APPARATUS

BACKGROUND

1. Technical Field

The present invention relates to a liquid injecting head that injects a liquid, a method of manufacturing the liquid injecting head, and a liquid injecting apparatus including the liquid injecting head, and more particularly, to an ink-jet record head that injects ink as the liquid, a method of manufacturing the ink-jet record head, and an ink jet recording apparatus 2. Related Art In ink-jet record heads that are major examples of the liquid injecting heads, generally, ink is supplied to a head main body from an ink cartridge that is a liquid storing unit in which ink fills through an ink flowing path that is formed in an ink supplying needle that is an ink supplying body detachably inserted into the ink cartridge and a supply member such as a cartridge case in which the ink cartridge is held. In addition, by driving a pressure generating unit such as a piezoelectric element that is installed to the head main body, the ink supplied to the head main body is injected from a nozzle.

In the ink-jet record heads, there is a problem that injection defect such as dot missing due to the air bubbles occurs in a case where air bubbles contained in the ink of the ink cartridge or air bubbles mixed into the ink at a time when the ink cartridge is attached or detached are supplied to the head main body. In order to solve the above-described problem, an ink-jet record head in which a filter for removing air bubbles or dust inside the ink is disposed between the ink supplying needle that is inserted into the ink cartridge and the supply member has been disclosed (for example, see JP-A-2000-211130).

In addition, the filter and the supply member are fixed by a heat welding process or the like, and the ink supplying needle and the supply member are fixed by an ultrasonic welding process or the like.

However, under the configuration disclosed in JP-A-2000-211130, the filter is installed to an area in which the ink supplying needle of the supply member is fixed, and thus, the area corresponding to the area of the filter is needed. In addition, since areas for individually welding the ink supplying needle and the filter to the supply member are needed, a gap between adjacent ink supplying needles cannot be shortened. As a result, there is a problem that the size of the head is increased.

In addition under the configuration disclosed in JP-A-2000-211130, when the area of filter is excessively reduced for miniaturizing the head, the dynamic pressure increases. Accordingly, there is a problem that a driving voltage that is used for driving a pressure generating unit such as a piezoelectric element or a heating element is needed to be increased.

In addition, when the ink supplying needle and the supply member are fixed by a heat welding process, a gap therebetween may be generated. In such a case, there is a problem that ink leaks from the gap. Furthermore, when the filter and the ink supplying needle are individually fixed to the supply member, there is a problem that the manufacturing cost increases.

Such problems exist not only in the ink-jet record head but also in a liquid injecting head that injects a liquid other than the ink.

SUMMARY

An advantage of some aspects of the invention is that it provides a liquid injecting head, a method of manufacturing the liquid injecting head, and a liquid injecting apparatus in which the head can be miniaturized and cost can be reduced by preventing leakage of the liquid assuredly.

According to a first aspect of the invention, there is provided a liquid injecting head that has a nozzle opening that injects a liquid supplied from a liquid storing unit that stores the liquid through a liquid supplying path. The liquid injecting head includes: a first supply member and a second supply member in which the liquid supplying path is formed; and a filter that is pinched by the first supply member and the second supply member and is disposed in correspondence with the liquid supplying path. In areas that surround the liquid supplying path of the first supply member and the second supply member on the filter side and face each other, filter pinching parts that are brought into contact with the filter are included and concave parts that surround the filter pinching parts are included on the outer side of the filter pinching parts. In addition, the first supply member, the filter, and the second supply member are bonded together by a bonding resin that is formed by flowing into the concave parts of the first supply member and the second supply member.

In the above-described liquid injecting head, by fixing the first supply member, the filter, and the second supply member to be integrated by using the bonding resin that is formed by an integral molding process, the areas for individually welding the filter to the first supply member and the second supply member are not needed. Accordingly, an effective area of the filter is increased, and a gap between adjacent supply bodies can be shortened. As a result, the head can be miniaturized. In addition, the area of the filter is not needed to be decreased for miniaturizing the head. Moreover, an increase in the dynamic pressure can be prevented, and accordingly, the driving voltage that is used for driving the pressure generating unit such as a piezoelectricity element or a heating element does not need to be raised. Furthermore, generation of a gap between the first supply member and the second supply member can be prevented assuredly by using the bonding resin, and accordingly, leakage of the liquid from the gap can be prevented assuredly.

In the above-described liquid injecting head, it is preferable that the filter has at least one through hole that perforates the filter in the thickness direction in areas for facing the concave parts. In such a case, the bonding resin is formed in a state in which the bonding resin perforates the through hole, and accordingly, the filter is fixed more assuredly.

In the above-described liquid injecting head, it is preferable that a fine hole that allows a side opposite to the filter side and the concave part to be communicated with each other is disposed in each of the first supply member and the second supply member. In such a case, the fine hole serves as an air extracting hole at a time when the integral molding process is performed, and accordingly, the bonding resin can be formed more assuredly.

In the above-described liquid injecting head, it is preferable that an outer area of the concave part of each of the first supply member and the second supply member becomes a filter pressing part that is brought into contact with the filter. In such a case, the outer circumferential part of the filter is pinched by the filter pressing part, and accordingly, the filter is fixed more assuredly.

In the above-described liquid injecting head, it is preferable an outer part that is continuous from the bonding resin and covers the first supply member, the second supply member, and the filter is disposed on the outer circumferences of the first supply member and the second supply member. In such a case, the outer circumferential part of the filter can be held by the outer part more assuredly, and accordingly, occurrence of the filter that is unsupported or detached can be prevented more assuredly.

According to a second aspect of the invention, there is provided a liquid injecting apparatus including the above-described liquid injecting head. According to this aspect, a liquid injecting apparatus that is miniaturized and low cost can be implemented.

According to a third aspect of the invention, there is provided a method of manufacturing a liquid injecting head having a nozzle opening that injects a liquid supplied from a liquid storing unit that stores the liquid through a plurality of liquid supplying paths. The liquid injecting head includes: a first supply member and a second supply member that form the plurality of liquid supplying paths; and a filter that is pinched by the first supply member and the second supply member and has a plurality of filter main bodies corresponding to at least the plurality of liquid supplying paths. In areas that surround the liquid supplying paths of the first supply member and the second supply member on the filter side and face each other, filter pinching parts that are brought into contact with the filter are included and concave parts that surround the filter pinching parts are included on the outer side of the filter pinching parts. In addition, by placing the first supply member, the second supply member, and the filter in a mold in a state in which the filter is pinched between the first supply member and the second supply member and injecting a resin into concave parts, a bonding resin that bonds the first supply member, the second supply member, and the filter to be integrated is formed.

In the above-described liquid injecting head, by fixing the first supply member, the filter, and the second supply member to be integrated by using the bonding resin that is formed in the concave parts, the areas for individually welding the filter to the first supply member and the second supply member are not needed. Accordingly, an effective area of the filter is increased, and a gap between adjacent supply bodies can be shortened. As a result, the head can be miniaturized. In addition, the area of the filter does not need to be decreased for miniaturizing the head. In addition, an increase in the dynamic pressure can be prevented, and accordingly, the driving voltage that is used for driving the pressure generating unit such as a piezoelectricity element or a heating element is not need to be raised. Furthermore, generation of a gap between the first supply member and the second supply member can be prevented assuredly by using the bonding resin, and accordingly, leakage of the liquid from the gap can be prevented assuredly.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described in detail.

Embodiment 1

Figure 1:
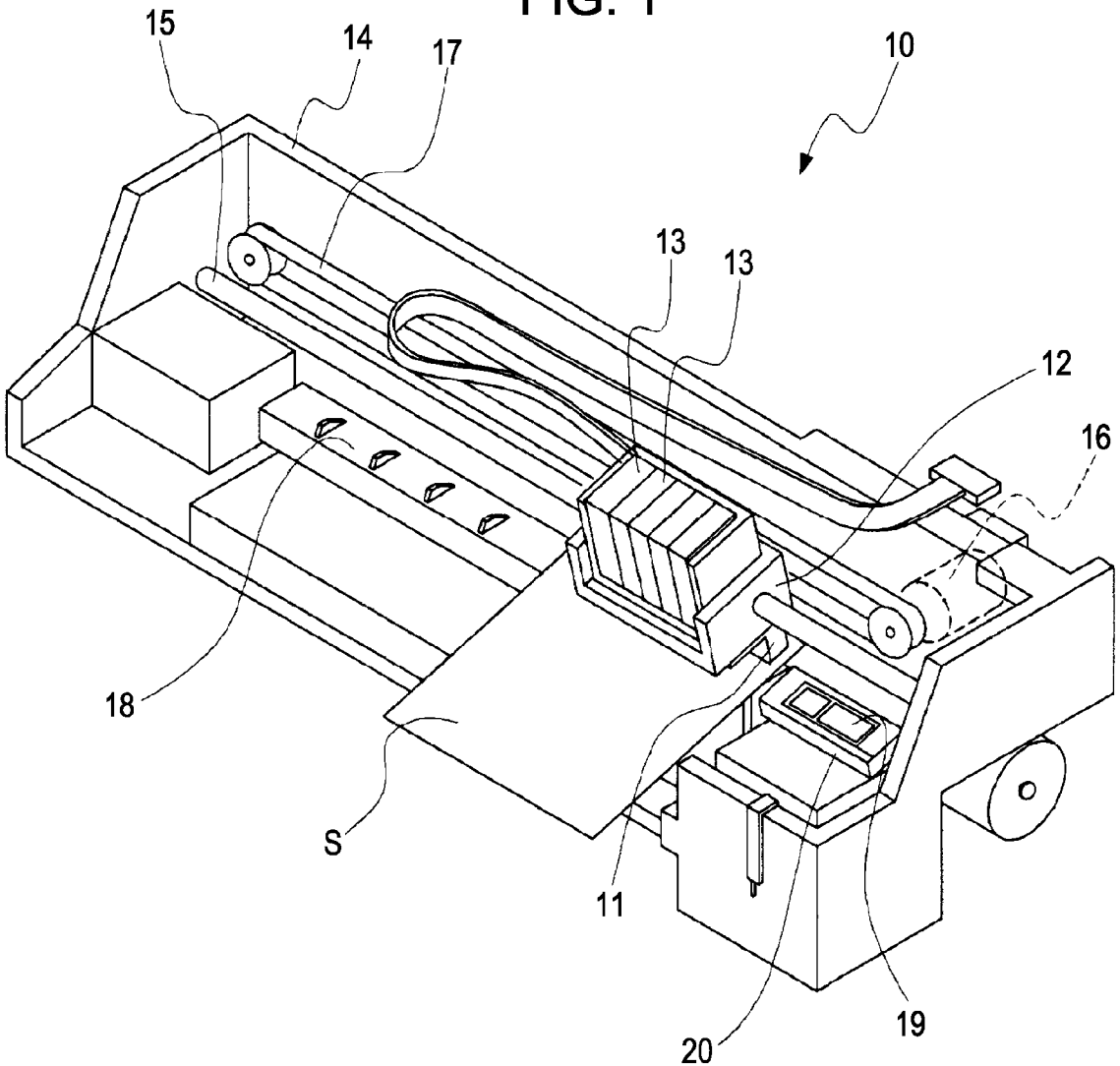
FIG. 1 is a schematic perspective view of a recording apparatus according to Embodiment 1 of the invention.

FIG. 1 is a schematic perspective view of an ink jet recording apparatus as an example of a liquid injecting apparatus according to Embodiment 1 of the invention. In the ink jet recording apparatus 10, as shown in FIG. 1, an ink-jet record head (hereinafter, also referred to as a record head) 11 as an example of a liquid injecting head that injects ink droplets is fixed to a carriage 12. To this record head 11, ink cartridges 13 as liquid storing units in which ink of a plurality of different colors such as a black color (B), a light black color (LB), a cyan color (C), a magenta color (M), and a yellow color (Y) is stored are detachably fixed.

The carriage 12 in which the record head 11 is mounted is installed to a carriage shaft 15 that is installed to an apparatus main body 14 to be movable in the direction of the shaft. By transferring the driving force of a driving motor 16 to the carriage 12 through a plurality of gears not shown in the figure and a timing belt 17, the carriage 12 is moved along the carriage shaft 15. On the other hand, to the apparatus main body 14, a platen 18 is installed along the carriage shaft 15, and a recording medium S such as a paper sheet that is fed by a paper feed device not shown in the figure or the like is configured to be transported to the platen 18.

In addition, in a position corresponding to a home position of the carriage 12, that is, an area near one end part of the carriage shaft 15, a capping device 20 including a cap member 19 that seals the nozzle forming face of the record head 11 is installed. By sealing the nozzle forming face on which nozzle openings are formed by the cap member 19, dryness of ink can be prevented. In addition, the cap member 19 also serves to receive ink in a flushing operation.

Figure 2:
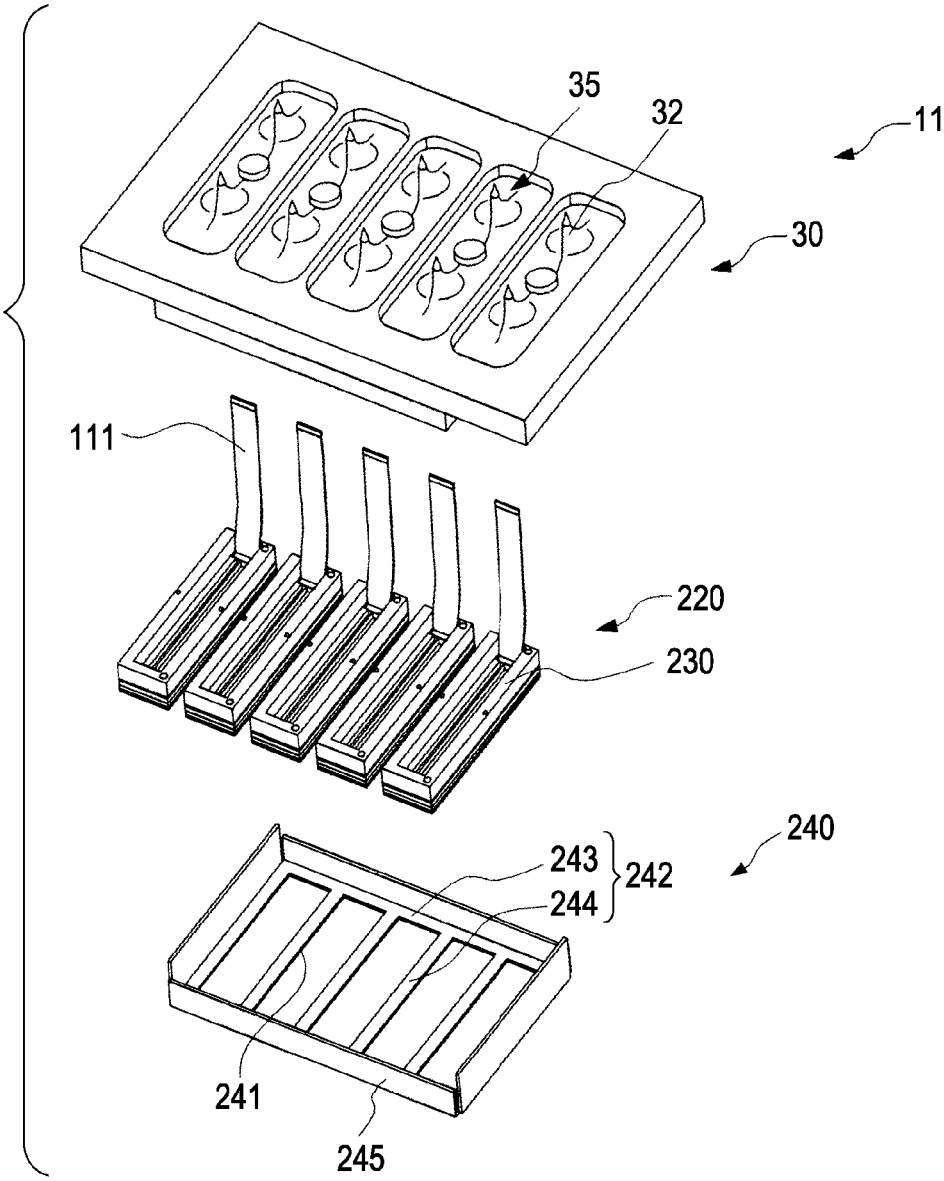
FIG. 2 is an exploded perspective view of a record head according to Embodiment 1 of the invention.

Here, the record head 11 according to this embodiment will be described. FIG. 2 is an exploded perspective view of the ink-jet record head as an example of a liquid injection head according to this embodiment.

As shown in FIG. 2, the record head 11 includes a supply member 30 such as a cartridge case to which the ink cartridge 13 as a liquid storing unit is fixed, a head main body 220 that is fixed to a side opposite to the ink cartridge 13 of the supply member 30, and a cover head 240 that is installed to the liquid injecting surface side of the head main body 220.

Figure 3:
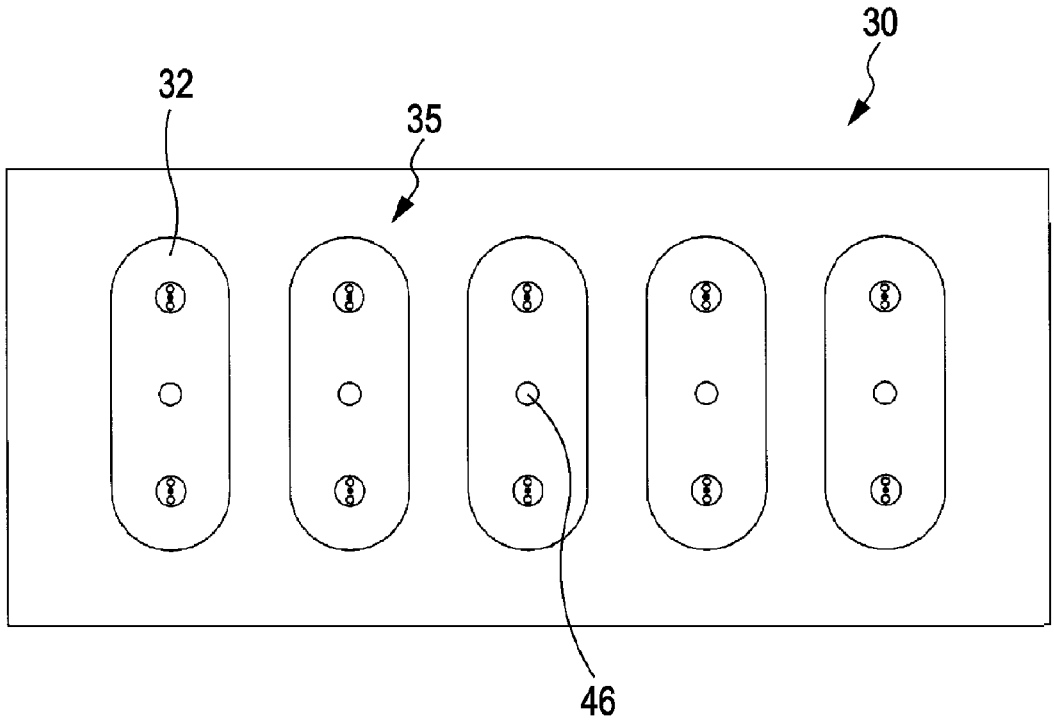
FIG. 3 is a top view of a supply member according to Embodiment 1 of the invention.
Figure 4:
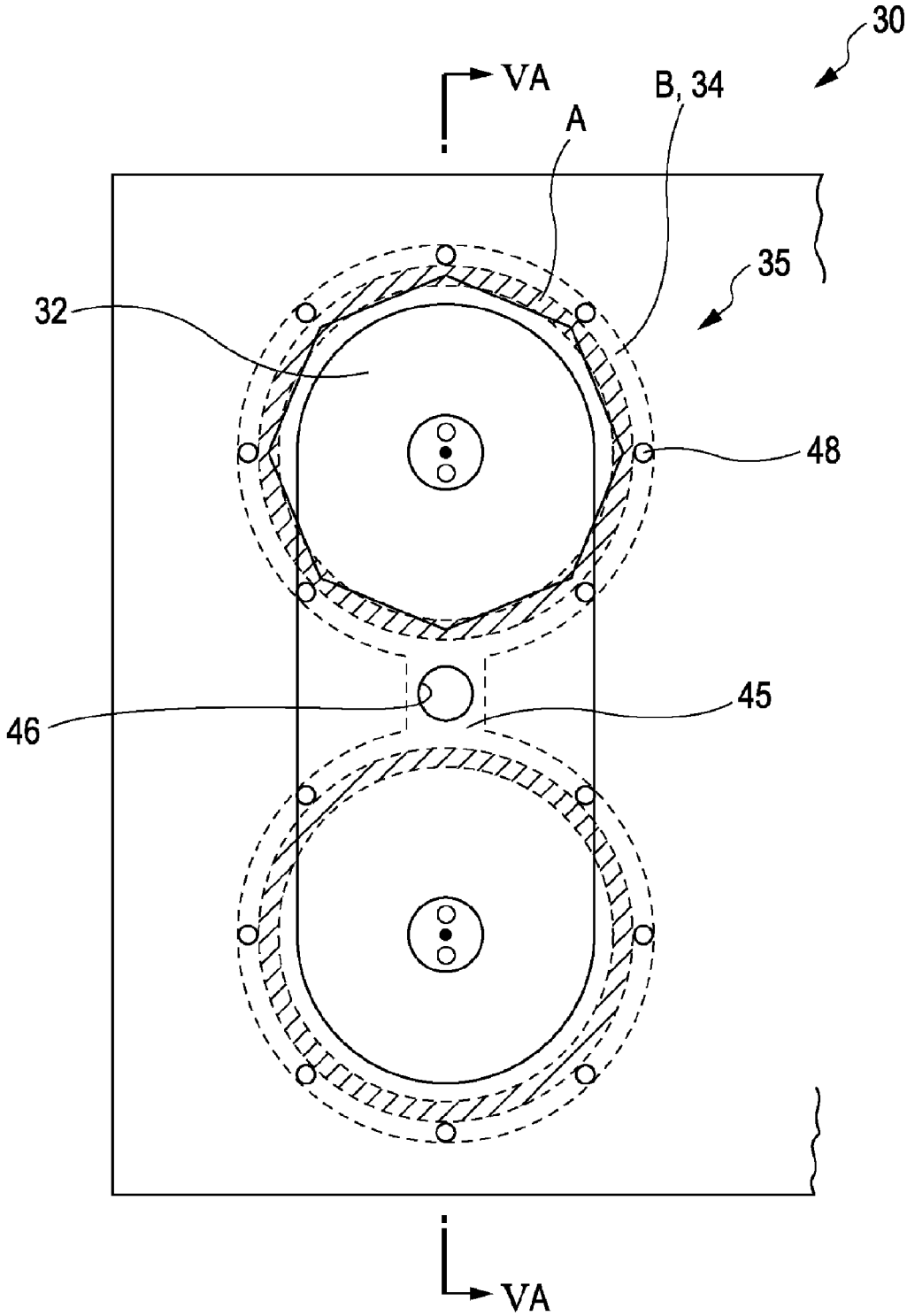
FIG. 4 is a top view showing an enlarged major part of a supply member according to Embodiment 1 of the invention.
Figure 5A:
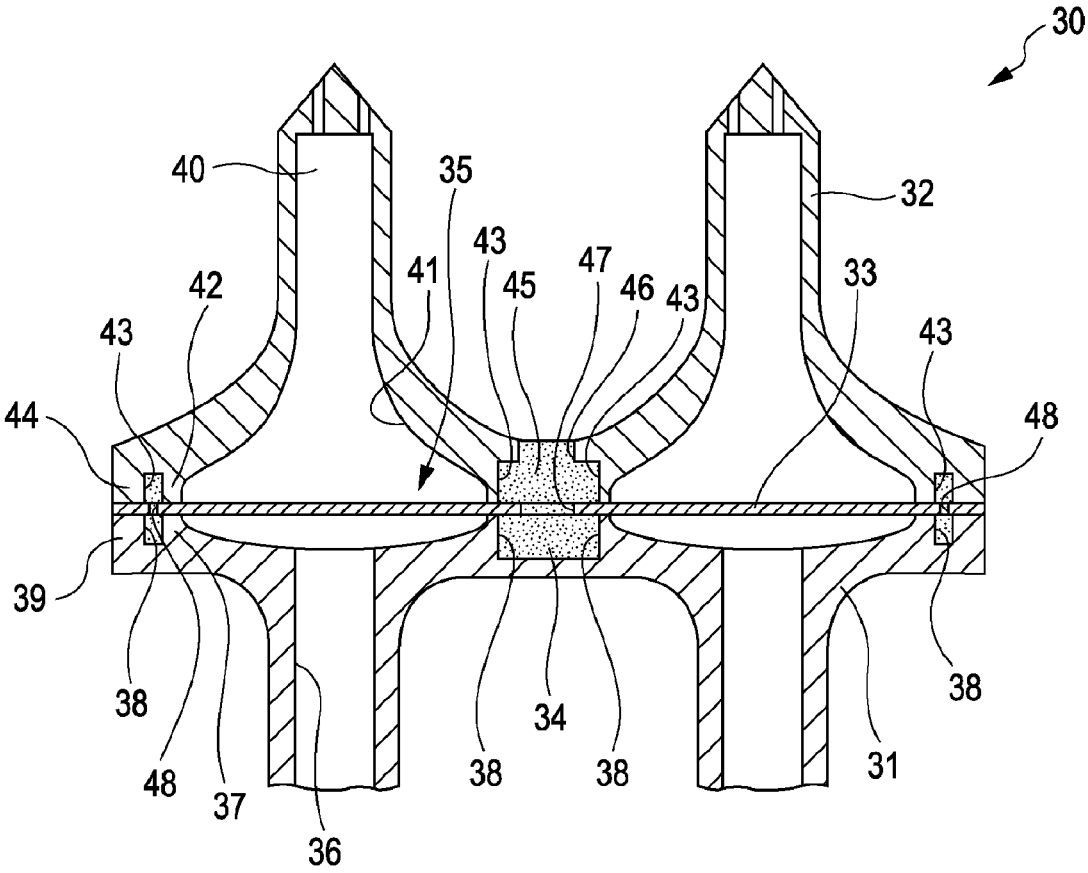
FIGS. 5A and 5B are cross-section views of a supply member according to Embodiment 1 of the invention.
Figure 5B:
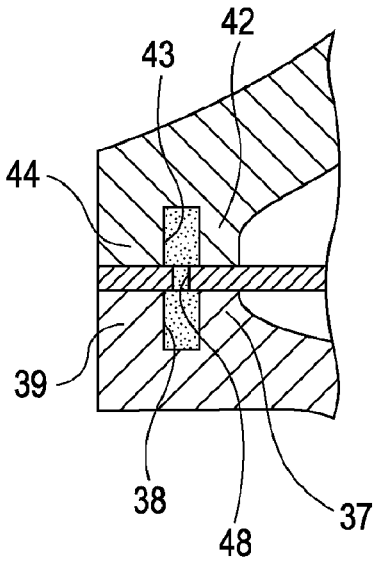

First, the supply member 30 will be described in detail. FIG. 3 is a top view of the supply member. FIG. 4 is a top view showing an enlarged major part of the supply member. FIGS. 5A and 5B are cross-section views taken along line VA-VA shown in FIG. 4.

As shown in FIGS. 5A and 5B, the supply member 30 is acquired from pinching a filter with a first supply member and a second supply member. According to this embodiment, the supply member 30 is acquired from integrally forming a supply member main body 31 that is disposed on the downstream side of a flow path corresponding to one between the first supply member side and the second supply member, a supply needle 32 that is disposed in the other between the first supply member and the second supply member disposed on the upstream side of the supply member main body 31, and the filter 33 disposed between the supply member main body 31 and the supply needle 32 by using a bonding resin 34.

The supply member 30 has a supply body forming part 35, to which the above-described ink cartridges 13 (corresponding to the liquid storing units) are installed, formed on one side. The ink cartridges 13 may not be directly installed to the supply body forming part 35, and a configuration in which ink as a liquid is drawn to the supply body forming part 35 from the liquid storing unit through a tube may be used.

In addition, in the supply member main body 31, a liquid supplying path 36, which has one end open to the supply body forming part 35 and the other end open to the head main body 220 side and is used for supplying the ink from the ink cartridges 13 to the head main body 220, is installed on the downstream side of the filter 33 to be described later. In addition, a plurality of the liquid supplying paths 36 is installed in parallel with each other in the longitudinal direction of the supply member main body 31, and the ink supplying paths 36 are independently installed to the ink cartridges 13 that are set up for ink of each color.

In addition, a circumferential area of an opening of the liquid supplying path 36 on the surface (supply body forming part 35) of the supply member main body 31 is formed as a filter pinching part 37. The filter 33 is configured to be pinched between the filter pinching part 37 and the supply needle 32. Here, the circumferential area of the liquid supplying path 36 is a circumferential edge part that is close to the opening parts of the liquid supplying path 36 and a filter chamber 41. In the view point of saving the space, it is preferable that the circumferential edge part is located near the opening as possibly as can be. In addition, in an outer area of the filter pinching part 37, a concave part 38 that is indented from the filter pinching part 37 is disposed to surround the filter pinching part 37. In addition, the outer area of the concave part 38, according to this embodiment, is formed as a filter pressing part 39 that is brought into contact with the filter 33 at a same height as that of the filter pinching part 37.

The supply needle 32 that becomes the supply body is fixed to the surface (supply body forming part 35) of the supply member main body 31 and has a through path 40 that is communicated with the liquid supplying path 36. In a connection area of the through path 40 for the liquid supplying path 36, a space having an inner diameter larger than those of the other areas, that is, the filter chamber 41 as a large width part is disposed. For example, the filter chamber 41 according to this embodiment is formed such that the inner diameter increases toward the supply member main body 31 side. Accordingly, the opening part of filter chamber 41 on the filter 33 side become the liquid supplying opening, and the ink supplied from the ink cartridge 13 through the liquid supplying opening is configured to be supplied to the supply member main body 31.

An area of the supply needle 32 that surrounds the filter chamber 41 of the bottom face on the supply member main body 31 side has a filter pinching part 42 that corresponds to the filter pinching part 37 of the supply member main body 31 and pinches the filter 33 together with the filter pinching part 37. In addition, in an outer area of the filter pinching part 42, a concave part 43 that is indented from the filter pinching part 42 is disposed to surround the filter pinching part 42. In addition, an outer area of the concave part 43, according to this embodiment, becomes a filter pressing part 44 that is brought into contact with the filter 33 at a same height as that of the filter pinching part 42.

The filter 33, for example, has a sheet shape in which metal is delicately woven and is pinched by the supply member main body 31 and the supply needle 32. According to this embodiment, the filter 33 has a size that can be fitted into the area pinched by the supply member main body 31 and the supply needle 32.

Here, in the concave part 38 of the supply member main body 31 and the concave part 43 of the supply needle 32, the bonding resin 34 that is integrally formed by setting the supply member main body 31, the supply needle 32, and the filter 33 in a mold and by performing an injection molding process for a resin is formed. The bonding resin 34 is formed so as to surround the opening of the filter chamber 41 of the supply member main body 31 and the opening of the liquid supplying path 36 and seals the through paths 40 and the openings of the liquid supplying paths 36 assuredly in an independent state. Accordingly, the supply member main body 31, the supply needle 32, and the filter 33 are integrated, and thereby the occurrence of ink leakage from the adjacent liquid supplying path 36 can be prevented.

In addition, according to this embodiment, two supply needles 32 for two liquid supplying paths are integrated as one member by integrating the two supply needles 32. In other words, according to this embodiment, as shown in FIG. 3, five members are disposed for ten liquid supplying paths 36 (not shown). In addition, in areas between two supply needles 32, communication parts 45 that allow all the concave parts 38 and all the concave parts 43 on each side to be communicated with one another are included. In addition, in each communication part 45, a filling hole 46 communicated with a gate that is used for introducing a resin for forming the bonding resin 34 is formed.

The filter 33 may be independently disposed for each one liquid supplying path 36. Alternatively, one filter 33 that is continuous for a plurality of the liquid supplying paths 36 may be disposed. According to this embodiment, one filter 33 is disposed to be continuous for two liquid supplying paths 36. Thus, for filing in the concave part 38 of the supply needle 32 with the resin that is introduced from the filling hole 46 assuredly, the through hole 47 is formed In an area of the connection part of the filter 33 corresponding to the filling hole 46 The filters 33 corresponding to ten liquid supplying paths 36 may be connected together to be used as one filter.

The filter 33 has a net shape as described above, and thus, the resin that forms the bonding resin 34 penetrates into the net, so that the filter 33 and the bonding resin 34 are integrated with each other. However, in order to fix the filter 33 and fill with the resin more assuredly, according to this embodiment, a plurality of the through holes 48 is formed to extend in the circumferential direction with being almost equally spaced, in areas corresponding to the concave parts 38 and 43 of the filter 33. Accordingly, the supply member main body 31, the supply needle 32, and the filter 33 are integrated assuredly through the bonding resin 34. The through hole 48 is not necessarily disposed.

FIG. 4 is a partial plan view of the supply member 30. In the figure, an area of the filter 33 that is pinched by the filter pinching part 37 of the supply member main body 31 and the filter pinching part 42 of the supply needle 32 is denoted by area A, and an outer area of area A that is maintained by the bonding resin 34 is denoted by area B.

In addition, a plurality of the through holes 48 formed in area B of the filter 33 is shown. According to this embodiment, seven through holes 48 are disposed to extend on the circumference of each liquid supplying path 36 to be almost equally spaced.

As described above, the supply member 30 in which the supply member main body 31, the supply needle 32, and the filter 33 are integrally formed is formed by disposing the bonding resin 34. As described above, by using the bonding resin 34 that is formed by an integral molding process, the supply member main body 31, the supply needle 32, and the filter 33 are integrally formed. Accordingly, an area of the supply member main body 31 that is used for welding the supply needle 32 and the filter 33 is not needed. Thereby a gap of each adjacent supply needles 32 can be shortened, and liquid leakage between adjacent liquid supplying paths can be prevented completely. As a result, the head can be miniaturized. The area of the filter 33 is not needed to be reduced for miniaturizing the head. In addition, an increase in the dynamic pressure is prevented, and accordingly, the driving voltage that is used for driving the piezoelectric element 300 does not need to be raised.

In addition, the filter 33 and the supply needle 32 can be simultaneously fixed to the supply member main body 31 by disposing the bonding resin 34. Accordingly, the filter 33 and the supply needle 32 are not needed to be individually fixed to the supply member main body 31, and thereby the manufacturing cost can be reduced.

In addition, the supply member main body 31, the supply needle 32, and the filter 33 are fixed assuredly by the bonding resin 34, and accordingly, generation of a gap between the supply member main body 31 and the supply needle 32 is prevented. Therefore, leakage of ink from the gap can be prevented.

In addition, according to this embodiment, the bonding resin 34 is formed by the resin filling through the filling hole 46 that is disposed between two supply needles 32 integrally formed. The resin fills in the concave part 38 of the supply member main body 31 and the concave part 43 of the supply needle 32 through the communication part 45 that is communicated with the filling hole 46 so as to form the bonding resin 34.

Figure 6:
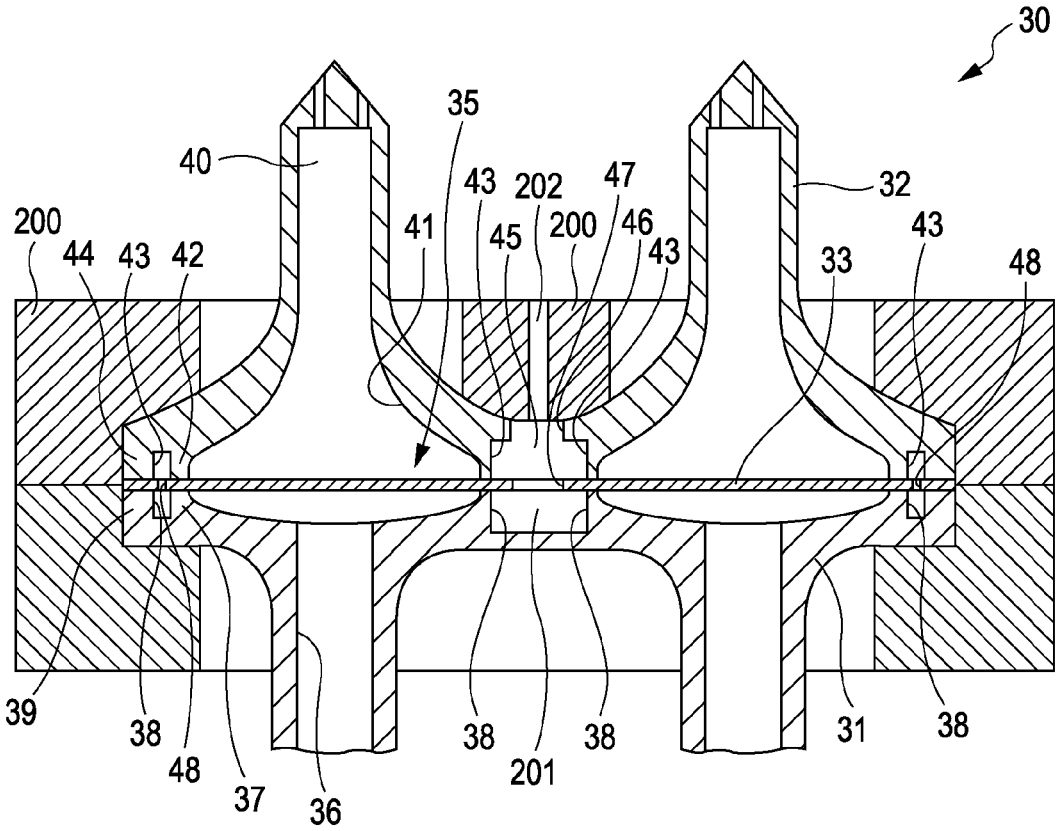
FIG. 6 is a cross-section view showing a method of manufacturing a supply member according to Embodiment 1 of the invention.
Figure 7:
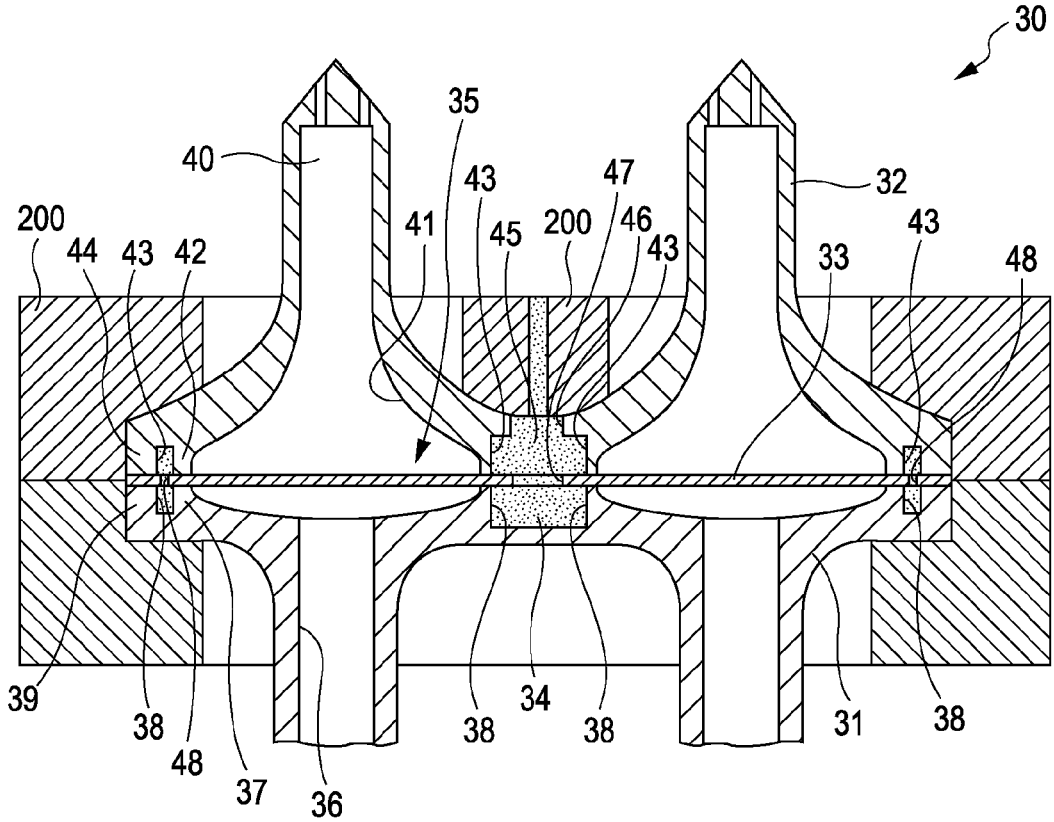
FIG. 7 is a cross-section view showing a method of manufacturing a supply member according to Embodiment 1 of the invention.

Here, the above-described ink-jet record head 11, and particularly, a method of manufacturing the supply member 30 will be described in detail. FIGS. 6 and 7 are cross-section views showing the method of manufacturing the supply member.

First, as shown in FIG. 6, the filter 33 is pinched between the supply member main body 31 and the supply needle 32. In other words, the filter 33 is placed inside a mold 200 in a state in which the filter 33 is pinched by the filter pinching part 37 and the filter pressing part 39 of the supply member main body 31 and the filter pinching part 42 and the filter pressing part 44 of the supply needle 32. In such a case, the supply member main body 31 and the supply needle 32 that are separately molded may be set in the mold 200. Alternatively, after the supply member main body 31 and the supply needle 32 are shaped by the mold 200, a continuous molding process may be performed.

The mold 200, for example, is formed by vertically divided members. In the mold 200, a cavity 201 for molding the communication part 45 and the gate 202 that is communicated with the cavity 201 are disposed.

As shown in FIG. 7, the supply member 30 is formed by filling the resin from the gate 202 and forming the bonding resin 34 by performing an integral molding process. In particular, the bonding resin 34 is molded by filling the melt resin in the cavity 201 through the gate 202 of the mold 200. At this moment, the melt resin filling in the cavity 201 fills in the concave part 38 of the supply member main body 31 and the concave part 43 of the supply needle 32. In addition, simultaneously, the melt resin fills in fine holes of the filter 33. Accordingly, the bonding resin 34 is formed so as to surround the circumference of area A that is pinched by the filter pinching part 37 of the supply member main body 31 and the filter pinching part 42 of the supply needle 32 (see FIG. 4).

Accordingly, the bonding resin 34 is disposed to extend on the circumference of the liquid supplying path 36 and fixes the supply member main body 31, the supply needle 32, and the filter 33 to be integrated.

In addition, as described above, since the through hole 48 is formed in the filter 33 according to this embodiment, the resin can easily flow into the inside of the concave parts 38 and 43 that are disposed on the upper and lower sides of the filter 33 through the through hole 48 inside the cavity 201 of the mold 200, and the melt resin can fill in the mold 200 in an easy manner. In addition, by disposing the through hole 48 in the filter 33, all the concave parts 38 of the supply member main body 31 and all the concave parts 43 of the supply needle 32 are filled with the resin, and whereby the bonding resin 34 can be formed. Accordingly, the liquid supplying path 36 can be sealed by the bonding resin 34 more assuredly.

For the supply member 30 formed as described above, processes for welding the filter 33 and the supply needle 32 to the supply member main body 31 are not needed. Accordingly, the supply member main body 31, the supply needle 32, and the filter 33 can be fixed to be integrated by performing one process for forming the bonding resin 34 by using the integral molding method. Thus, the cost can be reduced by simplifying the manufacturing process.

Figure 8:
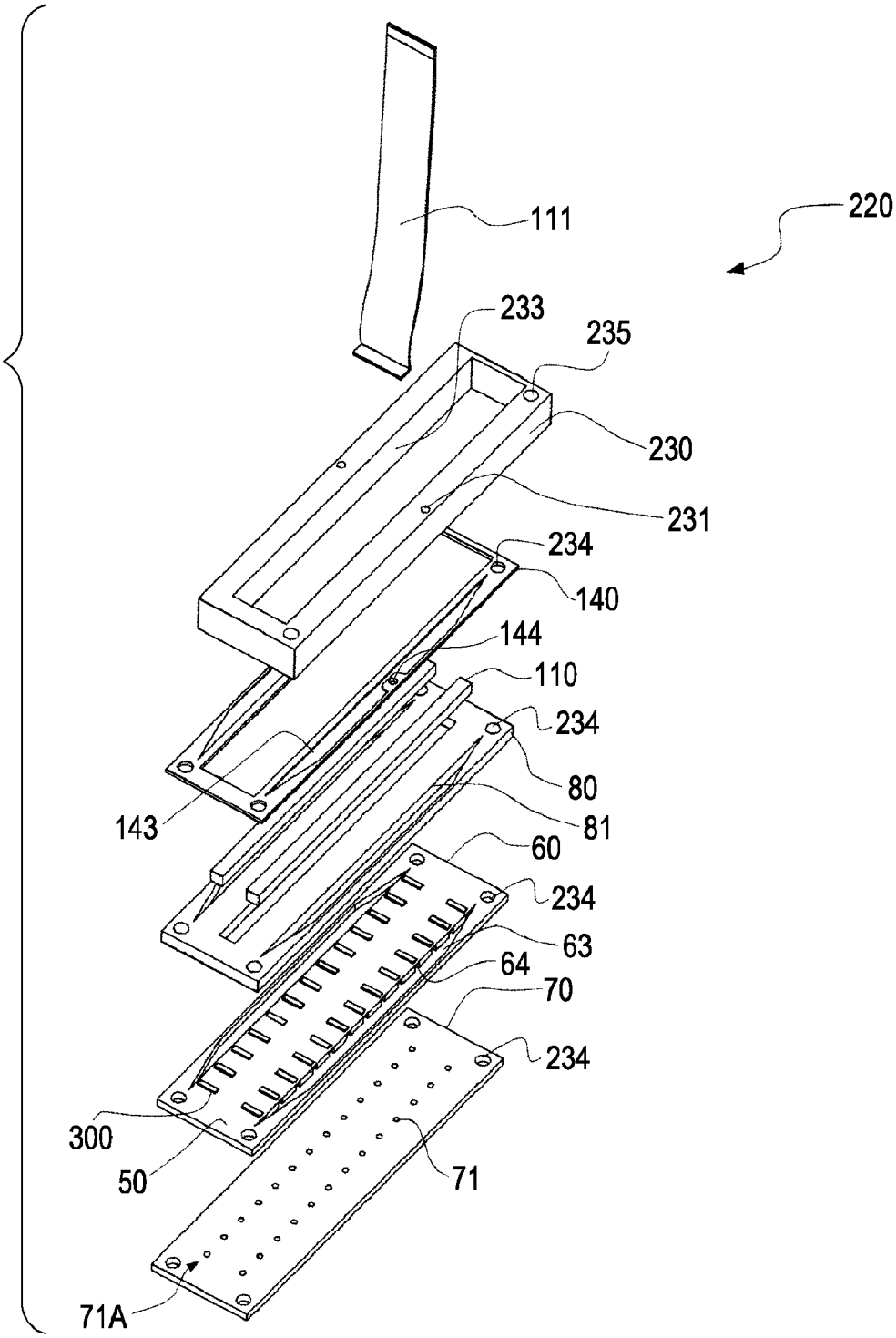
FIG. 8 is an exploded perspective view of a head main body according to Embodiment 1 of the invention.
Figure 9:
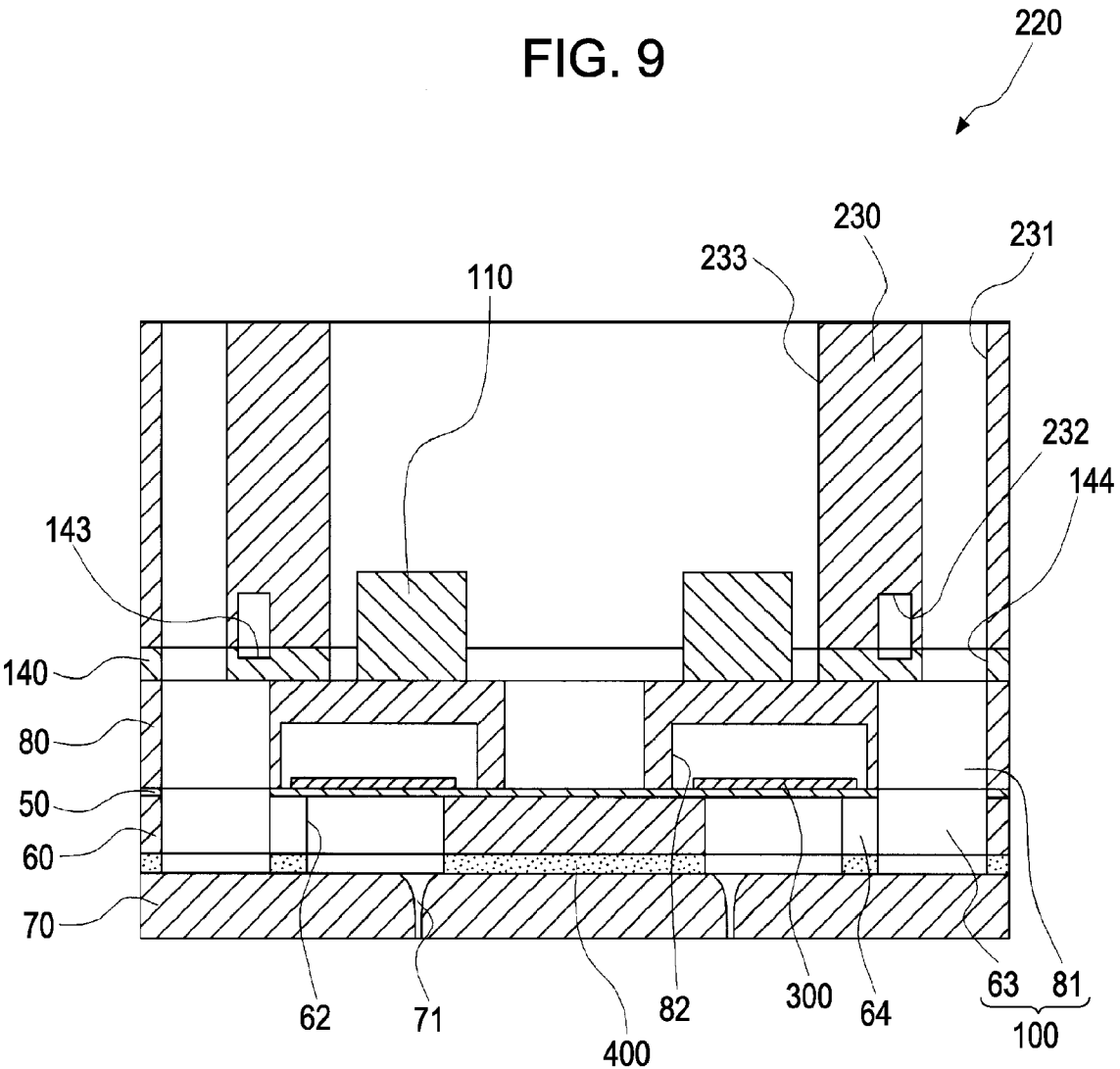
FIG. 9 is a cross-section view showing a head main body according to Embodiment 1 of the invention.

In addition, on the other side of the liquid supplying path 36 of the supply member 30, that is, a side opposite to the supply needle 32, a head main body 220 is disposed. Here, the head main body 220 will be described. FIG. 8 is an exploded perspective view of the head main body. FIG. 9 is a cross-section view of the head main body.

As shown in the figure, a flow path forming substrate 60 that constitutes the head main body 220 according to this embodiment is formed of a silicon monocrystal substrate. On one face of the flow path forming substrate 60, an elastic film 50 made of silicon dioxide is formed. On the flow path forming substrate 60, two rows of pressure generating chambers 62 partitioned by a plurality of partition walls that are disposed in parallel with each other in the width direction are formed by anisotropic etching from the other side. In addition, on the outer side of the pressure generating chambers 62 of each row in the longitudinal direction, a communication part 63 that is included in a reservoir 100 that is communicated with a reservoir part 81 disposed on a reservoir forming substrate 80 to be described later and becomes a common ink chamber of the pressure generating chambers 62 is formed. In addition, the communication part 63 is communicated with one end part of each pressure generating chamber 62 in the longitudinal direction through the ink supplying path 64. In other words, according to this embodiment, as a liquid flowing path that is formed on the flow path forming substrate 60, the pressure generating chamber 62, the communication part 63, and the ink supplying path 64 are disposed.

In addition, on the opening face side of the flow path forming substrate 60, a nozzle plate 70 in which the nozzle opening 71 is formed is fixed through an adhesive agent 400. In particular, a plurality of the nozzle plates 70 is disposed in correspondence with the plurality of the head main bodies 220. The nozzle plate 70 has an area that is slightly larger than that of the exposure opening part 241 of a cover head 240 to be described later in detail and is fixed by an adhesive agent or the like in an area overlapped with the cover head 240. In addition, the nozzle opening 71 of the nozzle plate 70 is perforated in a position that is communicated with the pressure generating chamber 62 on a side that is opposite to the ink supplying path 64. According to this embodiment, two rows in which the pressure generating chambers 62 are disposed in parallel with each other on the flow path forming substrate 60 are disposed, and thus, two rows of the nozzle rows 71A in which the nozzle openings 71 are disposed in parallel with each other in one head main body 220 are disposed. In addition, according to this embodiment, the face on which the nozzle openings 71 of the nozzle plate 70 are opened becomes the liquid injecting surface. As the nozzle plate 70, for example, a silicon monocrystal substrate, a metal substrate such as a stainless steel substrate (SUS) or the like may be used.

On the other hand, on a side of the flow path forming plate 60 that is opposite to the opening face, the piezoelectric element 300 that is formed by sequentially laminating a lower electrode film formed of metal, a piezoelectric body layer formed of a piezoelectric material such as lead zirconate titanate (PZT), and an upper electrode film formed of metal on the elastic film 50 is formed.

To the flow path forming substrate 60 on which the piezoelectric element 300 is formed, the reservoir forming substrate 80 including the reservoir part 81 that constitutes at least a part of the reservoir 100 is bonded. This reservoir part 81 according to this embodiment perforates the reservoir forming substrate 80 in the thickness direction and is formed to extend in the width direction of the pressure generating chamber 62. Thus, the reservoir part 81 constitutes the reservoir 100 that is communicated with the communication part 63 of the flow path forming substrate 60 and becomes a common ink chamber of the pressure generating chambers 62.

In addition, in an area of the reservoir forming substrate 80 that faces the piezoelectric element 300, a piezoelectric element holding part 82 having such a space that movement of the piezoelectric element 300 is not blocked is disposed.

In addition, on the reservoir forming substrate 80, a driving circuit 110 that is formed of a semiconductor integrated circuit (IC) for driving each piezoelectric element 300 and the like is disposed. The terminals of the driving circuit 110 are connected to lead-out wirings that are drawn out from individual electrodes of each piezoelectric element 300 through bonding wires not shown in the figure. In addition, the terminals of the driving circuit 110 are connected to external circuits through external wirings 111 such as a flexible printed circuit (FPC) board. Thus, the terminals of the driving circuit 110 are configured to receive various signals such as a print signal through the external wirings 111 from the external circuits.

In addition, to the reservoir forming substrate 80, a compliance substrate 140 is bonded. In an area of the compliance substrate 140 that faces the reservoir 100, an ink introducing opening 144 that is used for supplying ink to the reservoir 100 is formed to perforate the compliance substrate 140 in the thickness direction. In addition, an area other than the area of the ink introducing opening 144 that faces the reservoir 100 of the compliance substrate 140 is a flexible part 143 that is formed thin in the thickness direction, and the reservoir 100 is sealed by the flexible part 143. By this flexible part 143, compliance is given to the reservoir 100.

In addition, on the compliance substrate 140, a head case 230 is fixed.

The head case 230 is communicated with the ink introducing opening 144 and is also communicated with the liquid supplying path 36 of the supply member 30. In the head case 230, an ink communication path 231 that supplies ink from the supply member 30 to the ink introducing opening 144 is disposed. In this head case 230, in an area facing the flexible part 143 of the compliance substrate 140, a groove part 232 is formed such that bending deformation of the flexible part 143 is appropriately made. In addition, in an area of the head case 230 facing the driving circuit 110 that is disposed on the reservoir forming substrate 80, a driving circuit holding part 233 that perforates the head case 230 in the thickness direction is disposed, and the external wirings 111 are inserted into and passes through the driving circuit holding part 233 to be connected to the driving circuit 110.

In addition, the head main body 220 that is held by the supply member 30 through the head case 230, as shown in FIG. 2, is relatively positioned to be held by a cover head 240 having a box shape so as to cover the liquid injecting surface side of five head main bodies 220. The cover head 240 includes an exposure opening part 241 that exposes the nozzle opening 71 and a bonding part 242 that partitions the exposure opening part 241 and is bonded to both end part sides of the nozzle openings 71, which are disposed parallel to each other, of at least the nozzle row 71A of the liquid injecting surface of the head main body 220.

The bonding part 242 according to this embodiment is configured by a frame 243 that is disposed along the outer circumference of the liquid injecting surface extending over the plurality of the head main bodies 220 and a beam part 244 that is disposed to extend between adjacent head main bodies 220 and divides the exposure opening part 241. The frame 243 and the beam part 244 are bonded to the liquid injecting surface of the head main body 220, that is, the surface of the nozzle plate 70.

In addition, in the cover head 240, on the side of the side face of the liquid injecting surface of the head main body 220, a side wall part 245 that extends so as to be bent in the outer circumferential edge part of the liquid injecting surface is disposed.

As described above, since the bonding part 242 of the cover head 240 is bonded to the liquid injecting surface of the head main body 220, a level difference between the liquid injecting surface and the cover head 240 can be decreased. Thus, even when a wiping operation, a suction operation, or the like is performed for the liquid injecting surface, stay of the ink on the liquid injecting surface can be prevented. In addition, since the beam part 244 blocks between the adjacent head main bodies 220, ink dose not penetrate between the adjacent head main bodies 220. Accordingly, degradation and destruction of the piezoelectric element 300, the driving circuit 110, or the like due to ink can be prevented. In addition, since the liquid injecting surface of the head main body 220 and the cover head 240 are bonded together without any gap interposed therebetween by using an adhesive agent, it is prevented that the recording media S is inserted into the gap. Accordingly, deformation of the cover head 240 and the paper jam can be prevented. Furthermore, by covering the outer circumferential edge part of the plurality of the head main bodies 220 with the side wall part 245, circular inflow of the ink into the side faces of the head main bodies 220 can be prevented assuredly. In addition, since the bonding part 242 that is bonded to the liquid injecting surface of the head main body 220 is disposed in the cover head 240, each nozzle row 71A of the plurality of the head main bodies 220 can be positioned and bonded with high precision to the cover head 240.

As the cover head 240, for example, a metal material such as stainless steel can be used. In such a case, a metal plate may be formed by a press process or a molding process. In addition, the cover head 240 can be grounded by using a conductive metal material. In addition, the adhesive material used for boding the cover head 240 and the nozzle plate 70 together is not limited to a specific adhesive agent. Thus, for example, the bonding process may be performed by using a thermosetting epoxy-based adhesive agent or an ultraviolet-curable adhesive agent.

The ink-jet record head 11 according to this embodiment loads ink that is supplied from the ink cartridge 13, from the liquid supplying path 36. Then, after the insides from the reservoirs 100 to the nozzle openings 71 are filled with the ink through the ink supplying communication paths 231 and the ink introducing openings 144, the ink-jet record head 11 applies voltages to the piezoelectric elements 300 corresponding to the pressure generating chambers 62 in accordance with record signals transmitted from the driving circuit 110. Thereby, the elastic films 50 and the piezoelectric elements 300 are deformed in a flexible manner. Accordingly, the pressure inside each pressure generating chamber 62 increases, and thereby ink droplets are injected from the nozzle openings 71.

Embodiment 2

Figure 10:
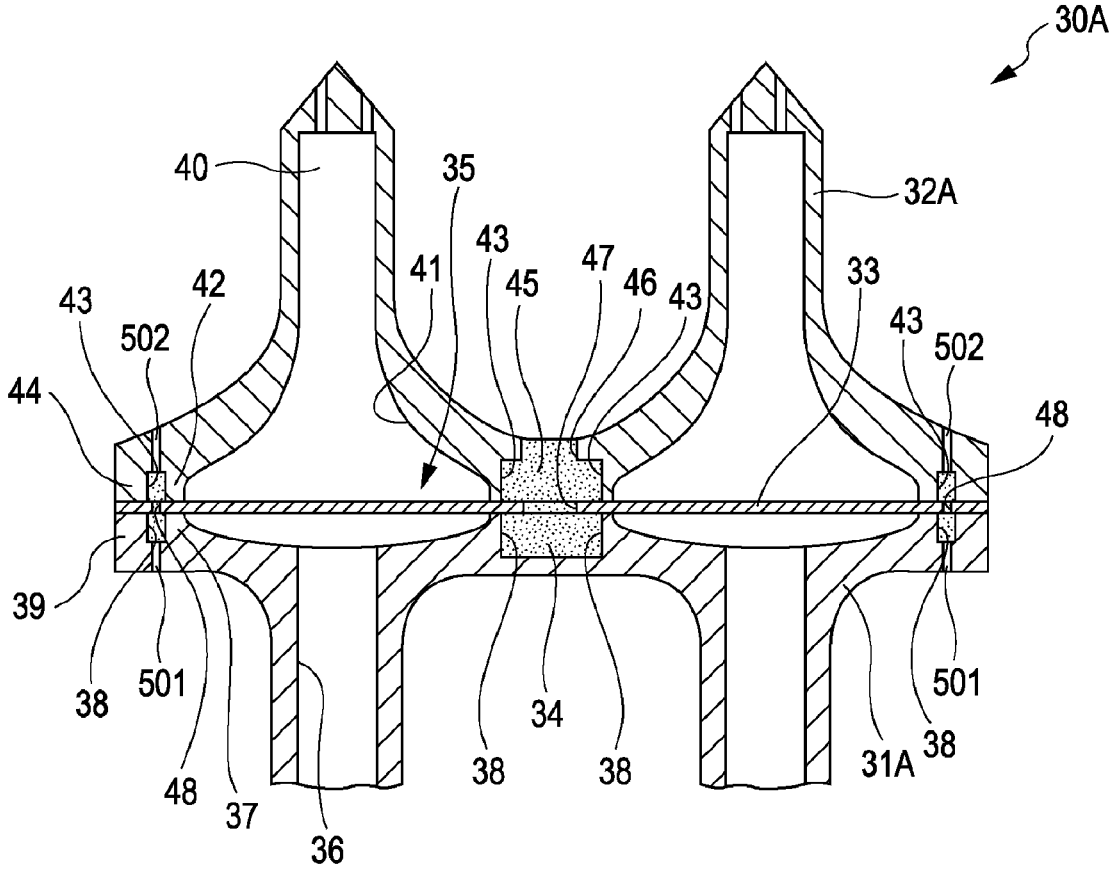
FIG. 10 is a cross-section view showing another example of a supply member according to Embodiment 2 of the invention.

FIG. 10 shows a cross-section view of a supply member according to Embodiment 2 of the invention. The supply member 30A according to this embodiment is the same as that according to Embodiment 1 except that fine holes 501 and 502 that become air extracting holes at a time when the supply member main body 31A and the supply needle 32A shape the bonding resin 34. Thus, to each same part as that of Embodiment 1, a same reference sign is assigned, and a duplicate description thereof is omitted here.

The fine hole 501 is formed to perforate from the bottom part of the concave part 38 of the supply member main body 31A to the surface of the supply member main body 31 that is located on a side opposite to the filter 33. In addition, the fine hole 502 is formed to perforate from the bottom part of the concave part 43 of the supply needle 32 to the surface of the supply needle 32A that is located on a side opposite to the filter 33. The fine holes 501 and 502 become air extracting holes at a time when the resin fills in the concave parts 38 and 43. Thus, for example, it is preferable that at least one fine hole is formed in an area located farthest from the gate 202. In addition, air flowing out from the fine holes 501 and 502 runs away to the outside through a gap of the mold or the like.

The fine holes 501 and 502 are not necessarily formed. For example, in the above-described Embodiment 1, the air inside the concave parts 38 and 43 may be configured to be let out from the gap between the supply member main body 31 and the filter 33 or the gap between the supply needle 32 and the filter 33. However, it is preferable that the fine holes are formed for forming the bonding resin 34 more assuredly.

Embodiment 3

Figure 11:
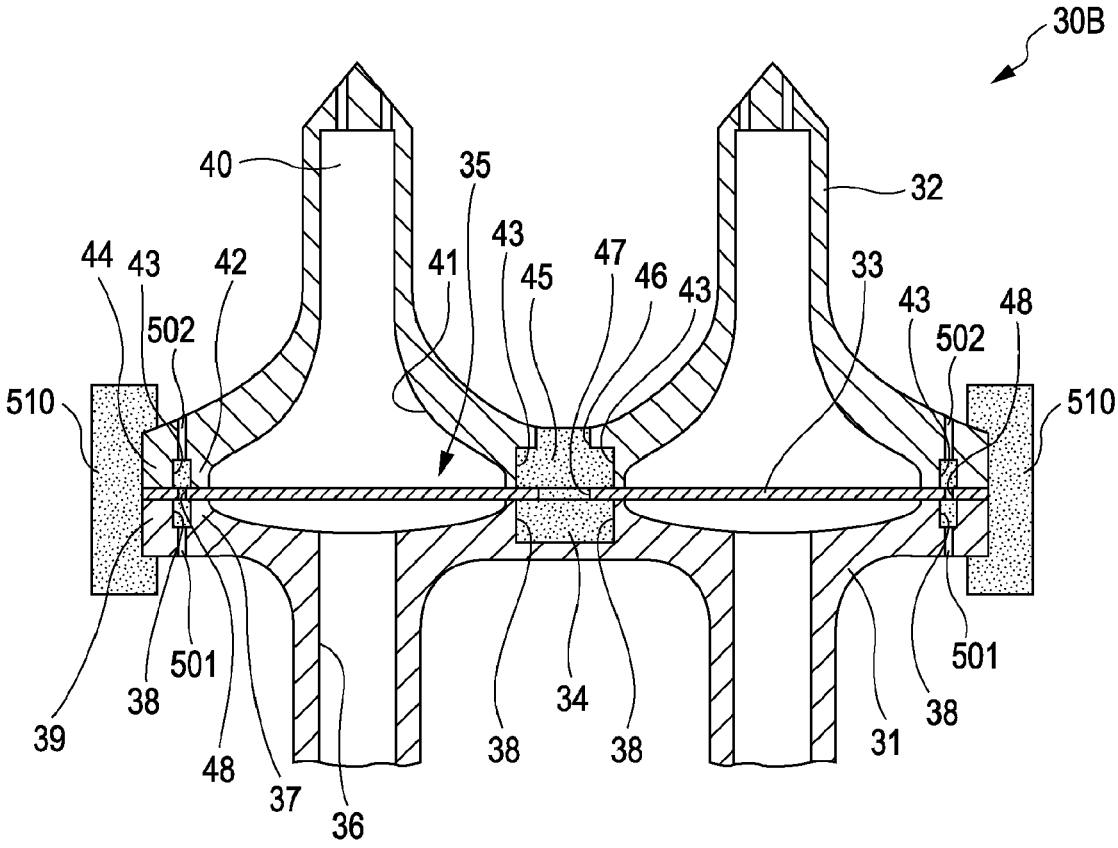
FIG. 11 is a cross-section view showing another example of a supply member according to Embodiment 3 of the invention.

FIG. 11 shows a cross-section view of a supply member according to Embodiment 3 of the invention. The supply member 30B according to this embodiment is the same as that according to Embodiment 1 except that an outer part 510 is included. Thus, to each same part as that of Embodiment 1, a same reference sign is assigned, and a duplicate description thereof is omitted here.

The outer part 510 is formed of a resin that is integrally formed on the outer circumference of the supply member main body 31 and the supply needle 32. The outer part 510 is integrally formed with the bonding resin 34, simultaneously. However, the outer part 510 may be molded by a separate process. By disposing the outer part 510, the outer part 510 is formed by also breaking into a gap between the supply member main body 31 and the supply needle 32 in which the filter 33 is not disposed. Accordingly, an advantage that the outer circumferences of the supply member main body 31, the supply needle 32, and the filter 33 are fixed assuredly is acquired.

The outer part 510 may be disposed by generating a gap between the outer circumference of the supply member main body 31 and the supply needle 32 and the filter 33 and filling the resin that is used for forming the outer part 510 in the gap. In such a case, the outer circumferential part of the filter 33 can be fixed more assuredly.

In such a case, even when the filter 33 protrudes from the outer circumference of the supply member main body 31 and the supply needle 32, the filter 33 can be fixed by the outer part 510.

The structure of the mold or the method of injecting the resin for integrally forming the outer part 510 with the bonding resin 34 is not particularly limited. Thus, the bonding resin 34 and the outer part 510 may be molded through one gate or a plurality of gates.

Other Embodiments

As above, the embodiments of the invention have been described. However, the basic configuration according to an embodiment of the invention is not limited thereto.

For example, the configuration of the first supply member and the second supply member is not limited to that of the above-described embodiments. In addition, in the above-described embodiments, it is configured that the first supply member is the supply member main body and the second supply member is the supply needle. However, an opposite configuration may be used. In addition, the entire supply member main body 31 that is connected to the head main body 220 is configured as the first supply member. However, it may be configured that the supply member main body 31 is divided into a filter 33 side and a head main body 220 side and the filter 33 side member is integrally formed with the filter 33 and the supply needle 32, as the first supply member. In such a case, by assembling the supply member main body on the head main body 220 side and the integrated member, the supply member 30 is configured.

In addition, in the above-described embodiments, one member that integrates two supply needles 32 is provided, and a plurality of supply needles 32 and the supply member main body 31 are integrated by using the bonding resin 34. However, the invention is not limited thereto. Thus, for example, the supply member main body 31 and the supply needle 32 may be independently provided, and the bonding resin 34 may be disposed in each of the supply member main body 31 and the supply needle 32. Alternatively, the bonding resin 34 that seals the above-described ten liquid supplying paths 36 to be integrated may be formed simultaneously. In addition, in the above-described embodiments, one member that integrates two supply needles 32 is provided, and one outer part 510 that extends on the outer circumference of the plurality of supply needles 32 and the supply member main body 31 is disposed. However, the invention is not limited thereto. Thus, for example, the supply member main body 31 and the supply needle 32 may be independently provided, and the outer part 510 may be disposed on each outer circumference of each of the supply member main body 31 and the supply needle 32.

In addition, the shapes of the connection part of the filter and the communication part 45 that becomes the bonding resin may not coincide with each other Thus, for example, in the embodiment shown in FIG. 4, the communication part 45 may be configured to have a width in the direction perpendicular to line VA-VA that is larger than that of the connection part of the filter 33. In such a case, the resin may easily flow in the circumference of the connection part of the filter 33.

In addition, in the above-described embodiments, the ink cartridge 13 as a liquid storing unit is disposed to be detachably attached to the supply member 30. However, the invention is not limited thereto. Thus, for example, an ink tank or the like as a liquid storing unit may be disposed in a position different from that of the record head 11, and the liquid storing unit and the record head 11 may be connected to each other through a supply tube such as a tube. In other words, in the above-described Embodiment 1, the supply needle 32 having a needle shape has been exemplified as the supply body. However, the supply body is not limited to have the needle shape.

In addition, in the above-described embodiments, a configuration in which one head main body 220 is installed for the plurality of liquid supplying paths 36 is described as an example. However, a plurality of the head main bodies may be disposed for each color of ink. In such a case, each liquid supplying path 36 is communicated with a corresponding head main body. In other words, each liquid supplying path 36 may be installed such that the nozzle openings disposed in the head main bodies are communicated for each nozzle row that is disposed to be parallel. Alternatively, the liquid supplying paths 36 may not be communicated for each nozzle row. Furthermore, one liquid supplying path 36 may be communicated with the plurality of the nozzle rows. In addition, the nozzles of one row may be divided into two groups, and each group may be communicated with each liquid supplying path 36. In other words, it is preferable that the liquid supplying path 36 is communicated with a group of nozzle openings selected from among a plurality of the nozzle openings In addition, in the above-described embodiments, embodiments of the invention have been described by exemplifying the ink-jet record head 11 that injects ink droplets. However, the invention is for the overall liquid injecting heads in a broad meaning. As the liquid injecting head, for example, there are a record head that is used for an image recording apparatus such as a printer, a color material injecting head that is used for manufacturing a color filter of a liquid crystal display or the like, an organic EL display, an electrode material injecting head that is used for forming an electrode of an FED (field emission display) or the like, and a bioorganic material injecting head that is used for manufacturing a bio chip.

The entire disclosure of Japanese Patent Application No. 2008-033792, filed Feb. 14, 2008 is incorporated by reference herein.

What is claimed is:

1. A liquid injecting head that has a nozzle opening that injects a liquid supplied from a liquid storing unit that stores the liquid through a liquid supplying path, the liquid injecting head comprising:

a first supply member and a second supply member in which the liquid supplying path is formed; and a filter that is pinched by the first supply member and the second supply member and is disposed in correspondence with the liquid supplying path, wherein, in areas that surround the liquid supplying path of the first supply member and the second supply member on the filter side and face each other, filter pinching parts that are brought into contact with the filter are included and concave parts that surround the filter pinching parts are included on the outer side of the filter pinching parts, and wherein the first supply member, the filter, and the second supply member are bonded together by a bonding resin that is formed by flowing into the concave parts of the first supply member and the second supply member, wherein an outer area of the concave part of each of the first supply member and the second supply member becomes a filter pressing part that is brought into contact with the filter.

2. The liquid injecting head according to claim 1, wherein the filter has at least one through hole that perforates the filter in the thickness direction in areas for facing the concave parts.

3. The liquid injecting head according to claim 1, wherein a fine hole that allows a side opposite to the filter side and the concave part to be communicated with each other is disposed in each of the first supply member and the second supply member.

4. The liquid injecting head according to claim 1, wherein an outer part that is continuous from the bonding resin and covers the first supply member, the second supply member, and the filter is disposed on the outer circumferences of the first supply member and the second supply member.

5. A liquid injecting apparatus comprising the liquid injecting head according to claim 1.

6. A method of manufacturing a liquid injecting head having a nozzle opening that injects a liquid supplied from a liquid storing unit that stores the liquid through a plurality of liquid supplying paths, the liquid injecting head including:

a first supply member and a second supply member that form the plurality of liquid supplying paths; and a filter that is pinched by the first supply member and the second supply member and has a plurality of filter main bodies corresponding to at least the plurality of liquid supplying paths, wherein, in areas that surround the liquid supplying paths of the first supply member and the second supply member on the filter side and face each other, filter pinching parts that are brought into contact with the filter are included and concave parts that surround the filter pinching parts are included on the outer side of the filter pinching parts, and wherein, by placing the first supply member, the second supply member, and the filter in a mold in a state in which the filter is pinched between the first supply member and the second supply member and injecting a resin into concave parts, a bonding resin that bonds the first supply member, the second supply member, and the filter to be integrated is formed, wherein an outer area of the concave part of each of the first supply member and the second supply member becomes a filter pressing part that is brought into contact with the filter.

* * * * *